US008863814B2

(12) United States Patent
Smart et al.

(10) Patent No.: US 8,863,814 B2
(45) Date of Patent: Oct. 21, 2014

(54) STRUCTURES AND METHODS FOR SECURING INSULATION TO PARTITIONS

(75) Inventors: R. Scott Smart, Sandy, UT (US); Craig G. Bell, South Jordan, UT (US)

(73) Assignee: Won-Door Corporation, Salt Lake City, UT (US)

( * ) Notice: Subject to any disclaimer, the term of this patent is extended or adjusted under 35 U.S.C. 154(b) by 310 days.

(21) Appl. No.: 13/023,596

(22) Filed: Feb. 9, 2011

(65) Prior Publication Data

US 2012/0199295 A1 Aug. 9, 2012

(51) Int. Cl.
*E05D 15/26* (2006.01)

(52) U.S. Cl.
USPC ..... 160/199; 160/40; 160/84.08

(58) Field of Classification Search
USPC ..... 160/199, 206, 232, 404, 84.08, 84.09, 160/84.11, 179, 89, 126; 52/404.02, 52/506.01, 506.05
See application file for complete search history.

(56) References Cited

U.S. PATENT DOCUMENTS

| | | | | | |
|---|---|---|---|---|---|
| 1,324,950 | A * | 12/1919 | Zrebiec | 160/398 |
| 2,321,507 | A * | 6/1943 | Oberdorfer et al. | 160/84.11 |
| 2,373,146 | A * | 4/1945 | Shearer | 160/84.11 |
| 2,417,922 | A * | 3/1947 | Frazer | 52/716.4 |
| 2,903,055 | A * | 9/1959 | Merrill | 160/84.11 |
| 2,953,201 | A * | 9/1960 | Richardson | 160/404 |
| 3,042,113 | A * | 7/1962 | Kramer | 160/404 |
| 3,082,817 | A * | 3/1963 | Merrill | 160/40 |
| 3,223,147 | A * | 12/1965 | Holloway | 160/84.09 |
| 3,348,628 | A * | 10/1967 | Dixon et al. | 181/287 |
| 3,570,579 | A * | 3/1971 | Matsushima | 160/235 |
| 3,763,918 | A * | 10/1973 | Clark | 160/371 |
| 3,952,470 | A * | 4/1976 | Byrd, Jr. | 52/509 |
| 4,257,204 | A * | 3/1981 | Rieger | 52/395 |
| 4,658,878 | A * | 4/1987 | Williams | 160/84.09 |
| 4,834,161 | A * | 5/1989 | Johnson et al. | 160/84.08 |
| 4,878,531 | A * | 11/1989 | Stover | 160/327 |
| 4,924,929 | A * | 5/1990 | Johnson et al. | 160/84.08 |
| 4,974,298 | A * | 12/1990 | Thallon | 24/710.5 |
| 5,033,529 | A * | 7/1991 | Koschade | 160/398 |
| 5,133,140 | A * | 7/1992 | Frey | 38/102.91 |
| 6,325,135 | B1 * | 12/2001 | Lee | 160/199 |
| 6,546,681 | B1 * | 4/2003 | Trundle | 52/202 |
| 7,748,181 | B1 * | 7/2010 | Guinn | 52/235 |
| 7,845,386 | B2 * | 12/2010 | Coleman et al. | 160/199 |
| 7,874,341 | B2 * | 1/2011 | Coleman et al. | 160/199 |
| 8,590,244 | B2 * | 11/2013 | O'Riordan | 52/407.4 |

* cited by examiner

*Primary Examiner* — Katherine Mitchell
*Assistant Examiner* — Johnnie A Shablack
(74) *Attorney, Agent, or Firm* — TraskBritt

(57) ABSTRACT

Movable partitions comprise a plurality of interconnected panels, at least one sheet of insulation adjacent the plurality of interconnected panels, and at least one hinge member connecting adjacent panels of the plurality of interconnected panels. The at least one hinge member comprises at least one pointed member that extends therefrom. The pointed member is at least partially inserted into the at least one sheet of insulation, and the at least one sheet of insulation is supported by a surface of the at least one pointed member that has a width that is greater than a thickness of the at least one pointed member.

21 Claims, 10 Drawing Sheets

STRUCTURES AND METHODS FOR SECURING INSULATION TO PARTITIONS

TECHNICAL FIELD

Embodiments of the present disclosure relate generally to partitions, and, more particularly, to attaching insulation to partitions.

BACKGROUND

Movable partitions are utilized in numerous situations and environments for a variety of purposes. Such partitions may include for example, foldable or collapsible doors configured to close-off an opening in order to enclose a room or to subdivide a single large room into one or more smaller rooms. The subdivision of one or more larger areas may be desired, for example, to accommodate the simultaneous meeting of multiple groups. In some applications, movable partitions are useful for providing privacy and noise reduction. In some applications, movable partitions are useful for providing a barrier, such as, for example, a security barrier or a fire barrier.

A partition system may further include insulation disposed in a space between two laterally spaced and substantially parallel partitions. For example, U.S. Pat. No. 3,223,147 to Holloway, issued Dec. 14, 1965, discloses panels of a resilient fibrous insulating material glued to a cover sheet. In such a configuration, the insulation may not span between the panels, leaving gaps at the hinges and potentially providing an insufficient barrier to heat and/or sound transfer. Thus, thicker insulation may be required, increasing the door's length when in a retracted state and, therefore, increasing the space required to store the door. Furthermore, the adhesive may not withstand high temperatures to which a partition system acting as a fire barrier may be subjected, causing the insulation to become detached and rendering the partition system ineffective as a fire barrier. As another example, U.S. Pat. No. 3,348,628 to Dixon et al., issued Oct. 24, 1967 discloses an insulating member attached to a panel of a folding door using fasteners to sandwich it between a hinge plate and a panel. In such a configuration, the fasteners and hinge plates may increase the manufacturing complexity of the partitions, and the hinge plates may increase the length of the door when in a retracted state and, therefore, increase the space required to store the door. Furthermore, repeated extension and retraction of the partition system may cause the insulation to move relative to the fasteners, and sharp or rough portions of the fasteners may wear, abrade, and/or cut at the insulation. Accordingly, the fasteners may cause the insulation to sag or even become detached over time.

BRIEF SUMMARY

In some embodiments, the present disclosure includes movable partitions comprising a plurality of interconnected panels, at least one sheet of insulation adjacent the plurality of interconnected panels, and at least one hinge member connecting adjacent panels of the plurality of interconnected panels. The at least one hinge member comprises at least one pointed member that extends therefrom. The pointed member is at least partially inserted into the at least one sheet of insulation, and the at least one sheet of insulation is supported by a surface of the at least one pointed member that has a width that is greater than a thickness of the at least one pointed member.

In additional embodiments, the present disclosure includes methods of installing a partition system. In accordance with such methods, at least one partition comprising a plurality of panels interconnected using a plurality of hinge members is hung from a track. At least one sheet of insulation is pushed against at least one pointed member that extends from at least one hinge member of the plurality of hinge members. At least a portion of the at least one pointed member is caused to extend at least partially through the at least one sheet of insulation, and the at least one sheet of insulation is suspended on a surface of the at least one pointed member that has a width that is greater than a thickness of the at least one pointed member.

BRIEF DESCRIPTION OF THE DRAWINGS

While the specification concludes with claims particularly pointing out and distinctly claiming that which are regarded as embodiments of the invention, various features and advantages of embodiments of the invention may be more readily ascertained from the following description of some example embodiments of the invention when read in conjunction with the accompanying drawings, in which:

DETAILED DESCRIPTION

Illustrations presented herein are not meant to be actual views of any particular device or system, but are merely idealized representations that are employed to describe embodiments of the present disclosure. Additionally, elements common between figures may retain the same numerical designation.

Figure 1:
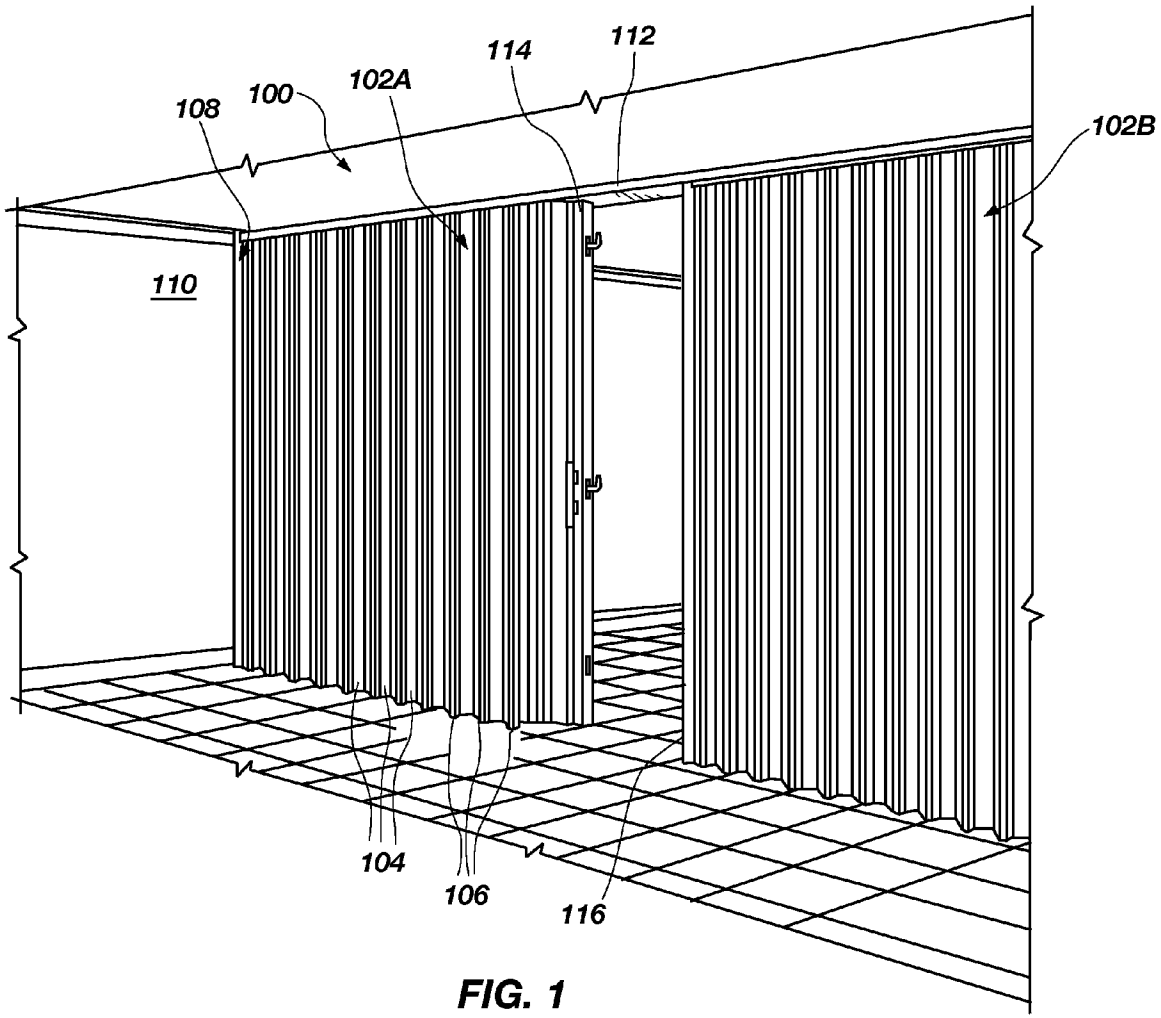
FIG. 1 is an illustration of a partition system according to an embodiment of the present disclosure.

Referring to FIG. 1, a movable or folding partition system 100 is shown in accordance with an embodiment of the present disclosure. The partition system 100 includes one or more foldable or accordion-type doors 102A and 102B, which may be used to enclose an area or subdivide a space into multiple, smaller spaces. The partition system 100 may be configured to provide a barrier to sight, sound, heat, fire, and/or physical entry. The doors 102A and 102B may include a plurality of panels 104, which are connected to one another with hinge members 106. The interconnection of the panels 104 enables the panels to fold and stack adjacent one another in an accordion-like or plicated manner such that the doors 102A and 102B may be compactly stored. When the doors 102A and 102B are deployed to subdivide an area in an extended state, the doors 102A and 102B may be displaced along a track 112 to provide the desired barrier.

Figure 2A:
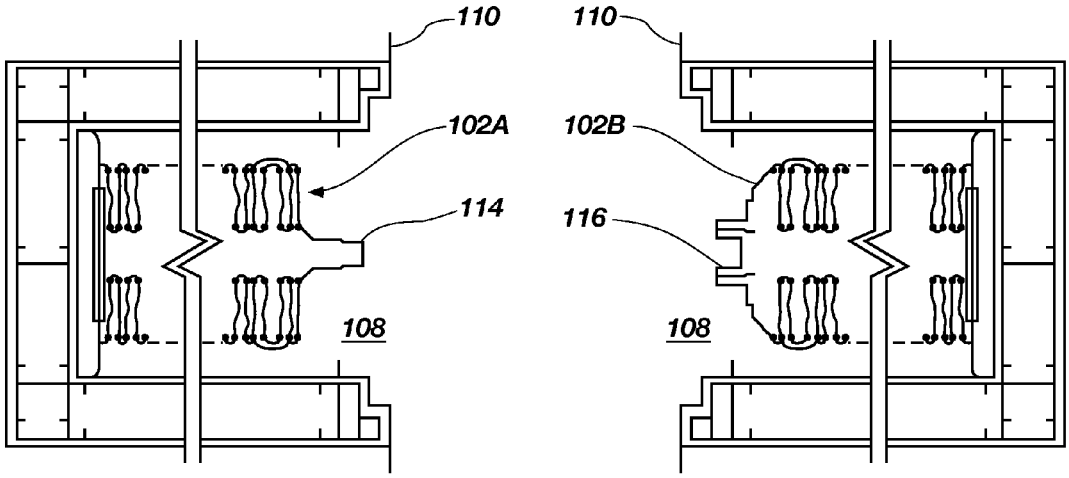
FIG. 2A is a cross-sectional view of a partition system in a bi-part configuration.

Referring to FIG. 2A, a cross-sectional view is shown of two doors 102A and 102B. A partition system 100 having two such doors 102A and 102B may be characterized as having a "bi-part" configuration. The doors 102A and 102B may be compactly stored in pockets 108 formed in walls 110 of a building when the doors 102A and 102B are in a folded or retracted state. In other embodiments, pockets 108 may not be formed in the walls 110, and the doors 102A and 102B may be mounted directly to the walls 110 and stored proximate the walls 110 in a folded or retracted state. The first door 102A includes a male lead post 114, which is configured to cooperatively mate with a female lead post 116 of the second door 102B when each of the doors 102A and 102B is properly deployed to an extended state.

Figure 2B:
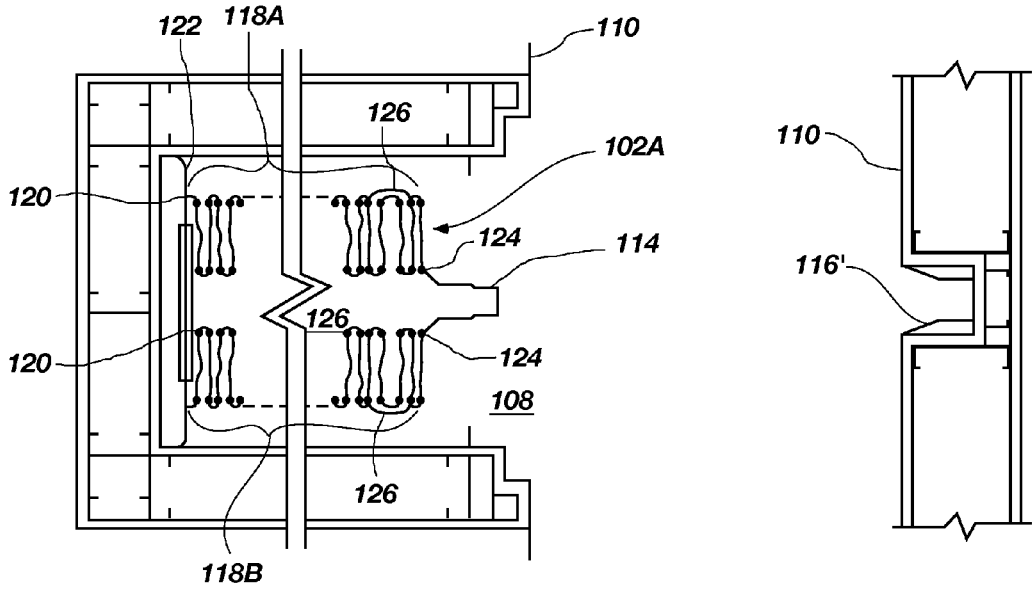
FIG. 2B is a cross-sectional view of a partition system including a single door, which mates with a stationary structure to form a barrier.

Alternatively, the partition system 100 may comprise a single door 102A, which mates with a stationary structure to form a barrier. As shown in FIG. 2B, a single door 102A may include a male lead post 114 which is configured to mate with a female door post 116' formed in a wall 110.

With continued reference to FIG. 2B, an accordion-type door 102A may include a first accordion-style partition 118A and a second accordion-style partition 118B which is laterally spaced from, and generally parallel to, the first partition 118A. Each of the two partitions 118A and 118B has a first end 120 structurally fixed to a floating jamb 122 that is movable within the pocket 108 and a second end 124 that is attached to the lead post 114. Such a configuration may be used, for example, as a sound barrier wherein the first partition 118A acts as a primary barrier, the second partition 118B acts as a secondary barrier, and the space 126 between the two partitions 118A and 118B acts as an insulator or a buffer zone.

The partition system 100 may include one or more securing mechanisms to maintain the two doors 102A and 102B relative to each other in a closed state, or to secure a single door relative to some other structure (e.g., a wall) in a closed state. The partition system 100 may be configured to be manually operated, automatically operated, or to be capable of both manual and automatic operation. For example, the partition system 100 may require one or more operators to extend the doors 102A and 102B to form a barrier or to retract the doors 102A and 102B to a stowed position. Additionally, the partition system 100 may require an operator to activate one or more securing mechanisms.

In additional embodiments, the partition system 100 may be configured with actuators, such as, for example, electric motors, or other mechanisms, configured to extend the doors 102A and 102B to form a barrier or to retract the doors 102A and 102B to a stowed position in a substantially automatic manner upon the occurrence of a predetermined event. Optionally, the partition system 100 may include mechanisms such as electric solenoids so that one or more securing mechanisms may be activated automatically.

Figure 3:
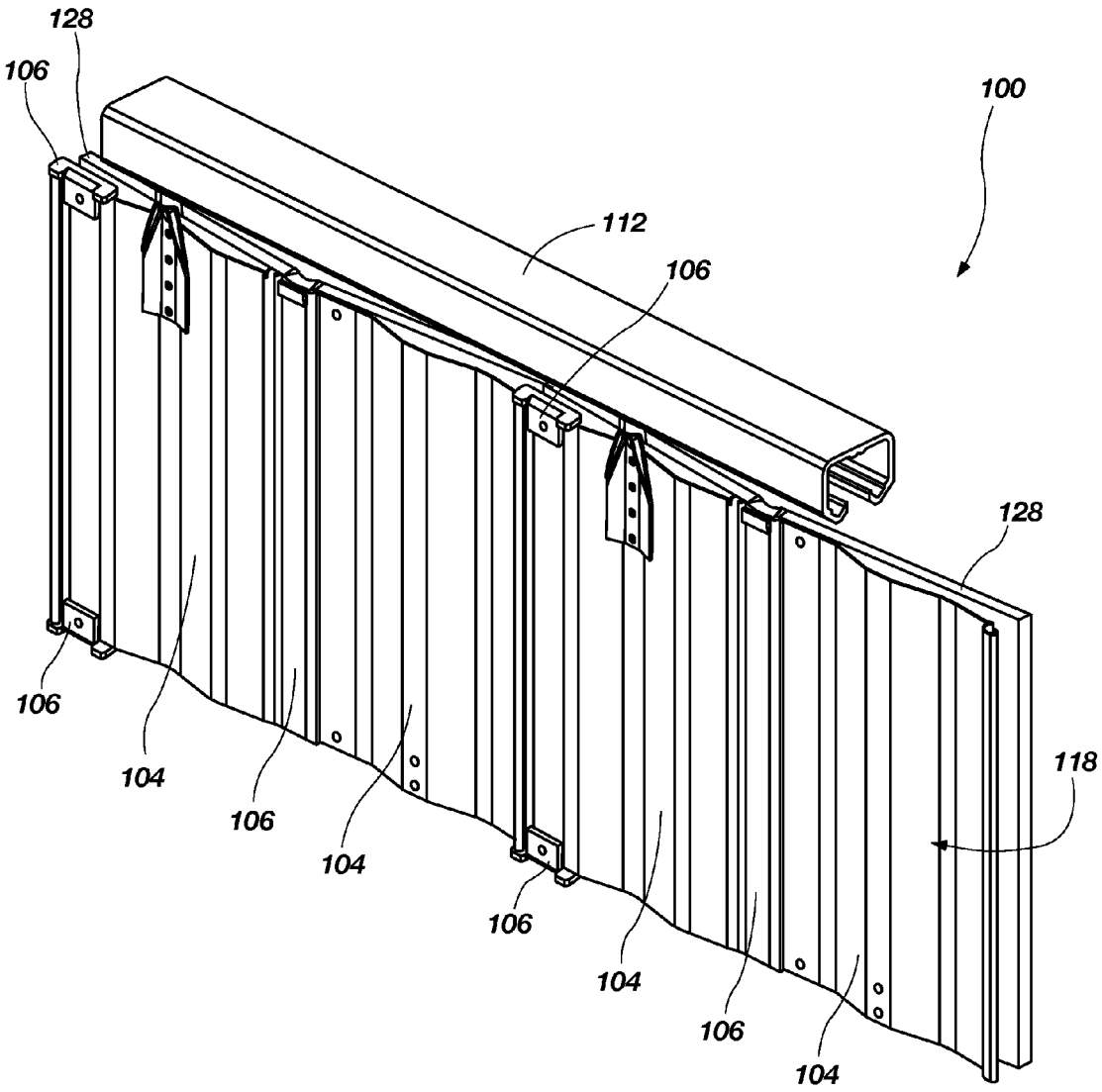
FIG. 3 is a simplified front view of a portion of a partition system in an extended state according to an embodiment of the present disclosure.

Referring to FIG. 3, a simplified front view of a portion of a partition system 100 in accordance with the present disclosure is shown. Only a single partition 118 is shown for clarity and simplicity. The partition 118 includes a plurality of interconnected panels 104, which are connected to one another with hinge members 106. The partition 118 is illustrated in an extended state. Every other hinge member 106 may comprise an elongate member spanning longitudinally (i.e., in a direction at least substantially parallel to vertical) from near the track 112 to near the bottoms of the panels 104. The remaining hinge members 106 may comprise connectors disposed at the top and bottom portions of the panels 104, and do not extend substantially in the longitudinal direction. The hinge members 106 are configured to attach to the panels 104 and cooperatively enable the panels 104 to fold relative to one another in a plicated manner to a retracted state. In other embodiments, each hinge member 106 may comprise an elongate member spanning longitudinally from near the track 112 to near the bottoms of the panels 104.

Figure 4:
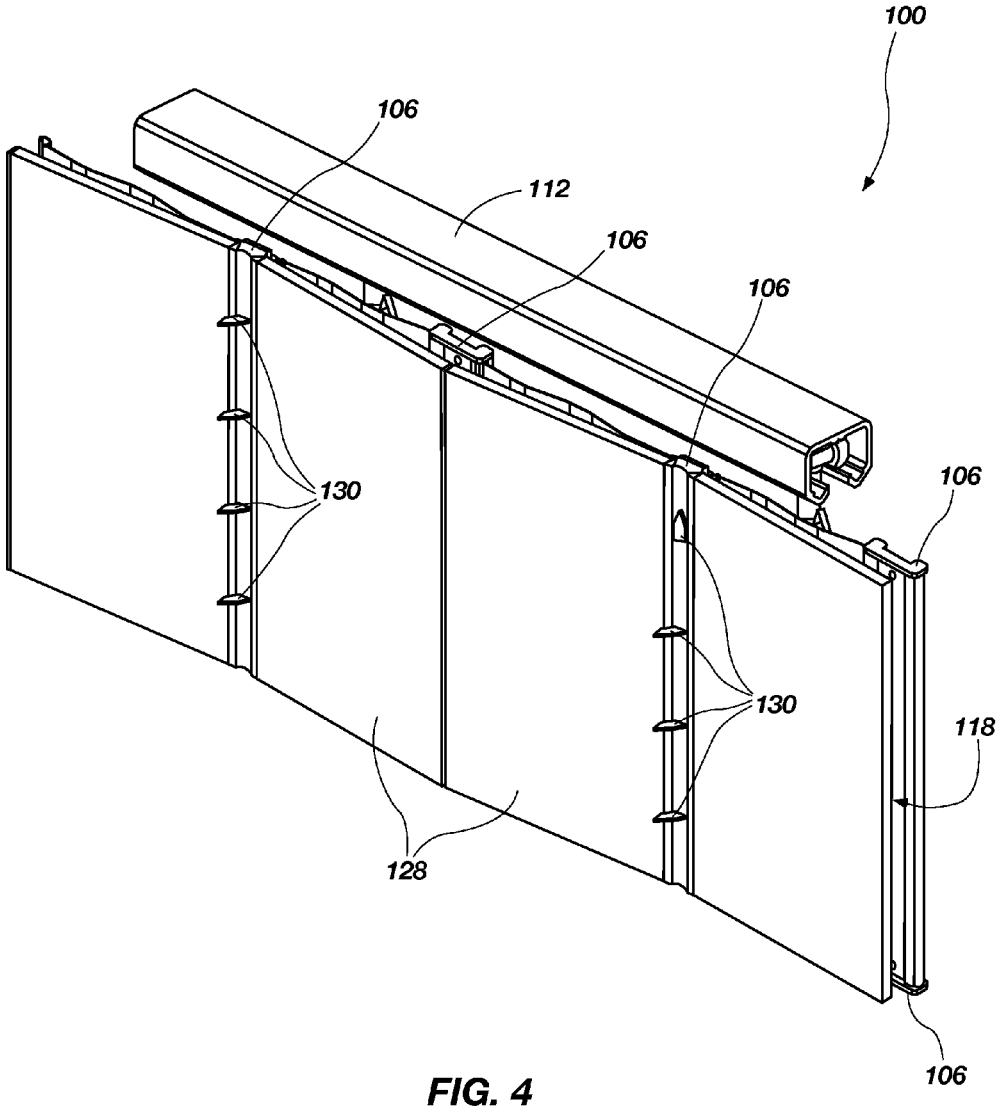
FIG. 4 is a simplified rear view of a portion of a partition system in an extended state according to an embodiment of the present disclosure.

Referring to FIG. 4, a simplified rear view of a portion of a partition system 100 in accordance with the present disclosure is shown. One or more sheets of insulation 128 are attached to the partition system 100 at the hinge members 106. Alternating hinge members 106 comprise a plurality of pointed members 130 protruding from the hinge members 106. In other embodiments, every fourth hinge member 106 may comprise a plurality of pointed members 130 protruding therefrom. In still other embodiments, the pointed members 130 may protrude from the panels 104, and the sheets of insulation 128 may be attached to the partition system 100 using the pointed members 130 protruding from the panels 104. The pointed members 130 may protrude toward a space between laterally spaced and substantially parallel partitions 118 (see FIG. 2B) of the partition system 100. The pointed members 130 penetrate at least partially into the sheets of insulation 128 to secure the sheets of insulation 128 to the partition 118. For example, the pointed members 130 may extend entirely through the sheets of insulation 128, such that a portion of each of the pointed members 130 protrudes beyond major surfaces of the sheets of insulation 128 on sides of the sheets of insulation 128 opposite the hinge members 106. The alternating connection to the hinge members 106 may reduce the strain placed on the sheets of insulation 128 during refraction and extension of the partition 118 because the sheets of insulation 128 are free to shift and move relative to portions of the sheets of insulation 118 where the sheets of insulation 128 are not connected to the pointed members 130, such as, for example, along the panels 104 and around the hinge members 106 that do not include pointed members 130.

The pointed members 130 may extend through the sheets of insulation 128 entirely. In some embodiments, the pointed members 130 be bent along the length of the pointed member 130 after the pointed members 130 have punctured through the sheets of insulation 128, causing portions of the pointed members 130 that protrude through the sheets of insulation 128 to point in an at least substantially vertical direction. For example, a pointed member 130 may protrude from a hinge member 106 through a sheet of insulation 128 toward a space between two laterally spaced and substantially parallel partitions 118, and may include a bend at a portion of the pointed member 130 protruding through the sheet of insulation 128 causing it to point toward a ceiling or a floor. In some embodiments, each bent pointed member 130 may point in the same direction. In other embodiments, some bent pointed members 130 may point in an opposite direction from other pointed members 130. Bending the pointed members 130 may enable the pointed members 130 to prevent the sheets of insulation 128 from sagging or rising and dragging against a floor or a ceiling. In addition, bending the pointed members 130 may enable the pointed members 130 to resist greater forces tending to pull the sheets of insulation 128 away from the hinge members 106 to which the sheets of insulation 128 are attached. In some embodiments, the pointed members 130 may include a barb at the pointed tip thereof to prevent the sheets of insulation 128 from becoming detached. In some embodiments, the sheets of insulation 128 may be joined together using, for example, staples, tape, or additional pointed members 130 located at an interface between the sheets of insulation 128. In other embodiments, the insulation may be in the form of a single sheet 128.

When installing the partition system 100, a partition 118 including a plurality of interconnected panels 104 and a plurality of hinge members 106 may be hung from a track 112. A sheet of insulation 128 may be brought proximate the partition 118. For example, the sheet of insulation 128 may be brought proximate the partition 118 on a side configured to face another partition 118B that is laterally spaced and substantially parallel to the first partition 118 to define a space therebetween. The sheet of insulation 128 may then be pressed against pointed members 130 extending from at least one hinge member 106 of the plurality. The pointed members 130 may puncture the sheet of insulation 128 and portions of the pointed members 130 may protrude beyond the sheet of insulation 128. The portions of the pointed members 130 that protrude beyond the sheet of insulation 128 may be bent to point in an at lease substantially vertical direction. For example, portions of the pointed members 130 that protrude beyond the sheet of insulation 128 may be bent to point all upward, all downward, or some upward and others downward. Some portions of the pointed members 130 that protrude beyond the sheet of insulation 128 may be bent, while others are left unbent.

Figure 5:
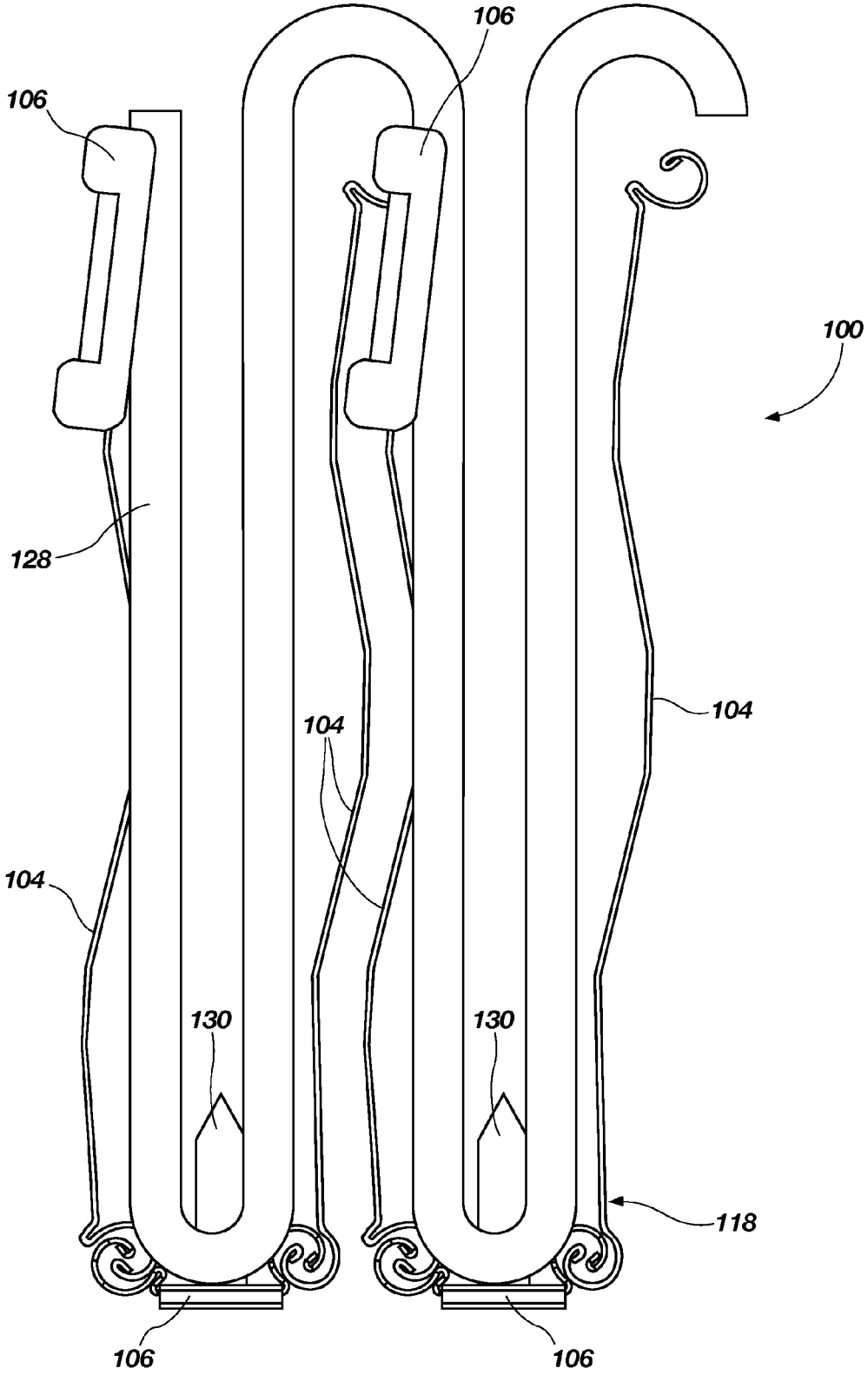
FIG. 5 is a simplified overhead view of a portion of a partition system in a refracted state according to an embodiment of the present disclosure.

FIG. 5 is a simplified overhead view of a portion of the partition system 100 in accordance with the present disclosure. The partition 118 is shown in a refracted state. The hinge members 106 comprising pointed members 130 may be disposed at portions of the partition 118 that protrude outwardly (i.e., protruding away from a space between laterally spaced and substantially parallel partitions 118) when in a refracted state, while the remaining hinge members 106 may be disposed at portions of the partition 118 that protrude inwardly (i.e., protruding toward the space between laterally spaced and substantially parallel partitions 118) when in a retracted state.

The sheets of insulation 128 may be configured to provide a barrier to sound. For example, the sheets of insulation 128 may comprise sheets of fiberglass approximately one-half inch (0.5 in) thick. The sheets of insulation 128 may also be configured to provide a barrier to fire. For example, the sheets of insulation 128 may comprise sheets of a refractory material, such as, for example, alumina, silica, magnesia, and/or lime, approximately one-half inch (0.5 in) to one and one-half inches (1.5 in) thick.

Figure 6:
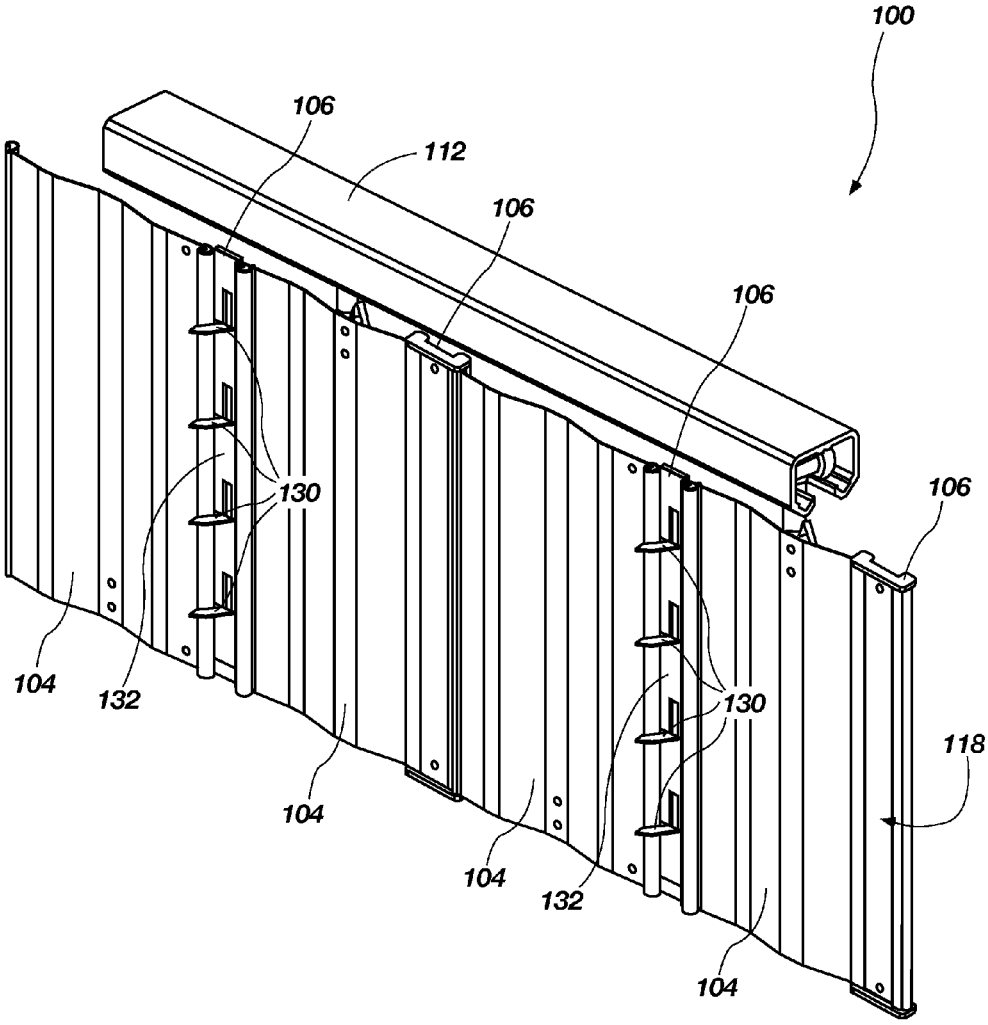
FIG. 6 is a simplified rear view of a portion of a partition system prior to installation of insulation according to an embodiment of the present disclosure.

Shown in FIG. 6 is a simplified rear view of a portion of a partition system 100 prior to attachment of sheets of insulation 128 (see FIGS. 3 and 4). The pointed members 130 protruding from the hinge members 106 may protrude at an angle of less than about ninety degrees) (90°) from vertical. Prior to installation of sheets of insulation 128, the pointed members 130 may be at least substantially straight. In some embodiments, the pointed members 130 may include a barb at the end thereof.

Figure 7:
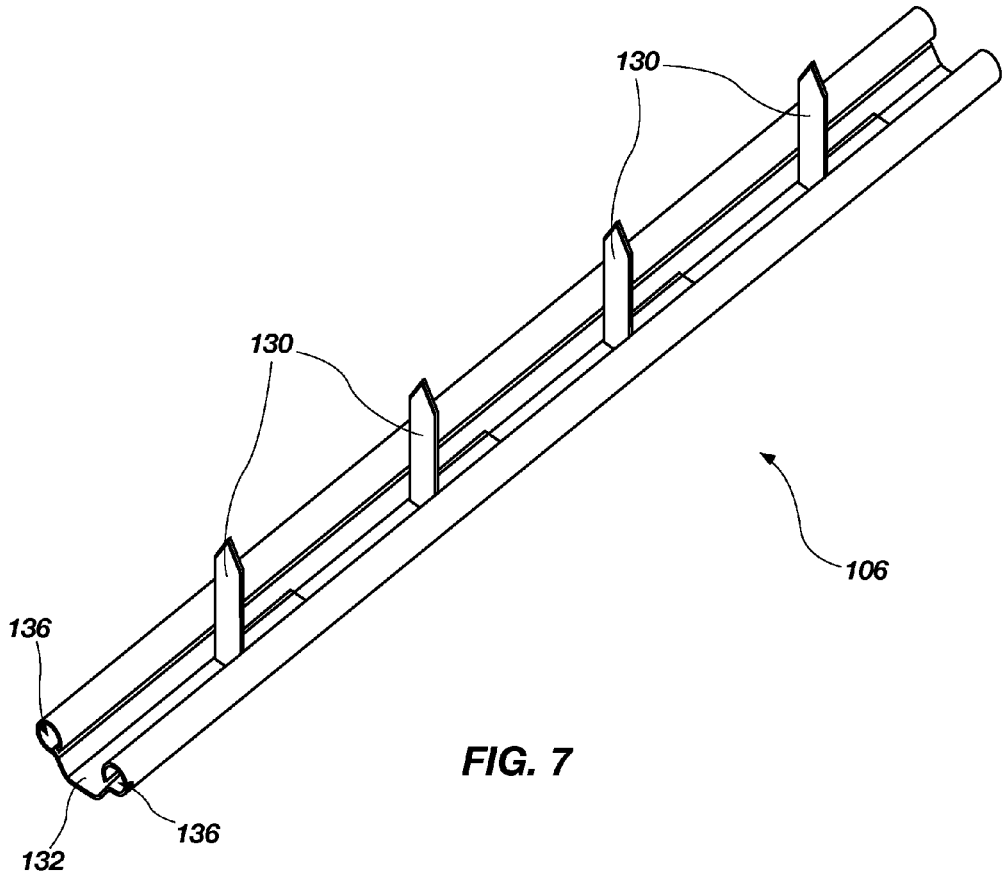
FIG. 7 is a simplified illustration of a hinge member for a partition system according to an embodiment of the present disclosure.

Referring to FIG. 7, an illustration of a hinge member 106 for a partition system is shown. The hinge member 106 may comprise an elongate member formed from a sheet 132 of material, such as, for example, sheet metal, that has been bent or otherwise formed to include annular structures 136 at the sides thereof to which panels 104 of a partition 118 (see FIG. 6) may be rotatably attached. The annular structures 136 may not comprise completely closed loops, an opening in the annular structure 136 being located between a terminal end of the annular structure 136 and the sheet 132 of material. The annular structures 136 may be configured to retain connection portions of the panels 104 therein as the partition 118 is extended or refracted and panels 104 rotate relative to the hinge member 106. The annular members 136 may each curve inwardly toward the center of the hinge member 106.

The hinge member 106 may comprise a plurality of pointed members 130 formed in the sheet 132 and protruding from a portion of the sheet 132 located between the annular structures 136. The pointed members 130 may comprise portions of the sheet 132 of material that have been cut, punched out, or otherwise separated from the sheet 132 on all but one side and then bent or folded to protrude from the sheet 132. In other embodiments, the pointed members 130 may comprise separate members that are formed as pointed members 130 and subsequently attached to the hinge member 106. The portion of each pointed member 130 that is not cut, punched out, or otherwise separated from the sheet 132 may extend in a direction transverse to vertical. The pointed members 130 may be configured to at least partially penetrate into sheets of insulation 118.

Figure 8:
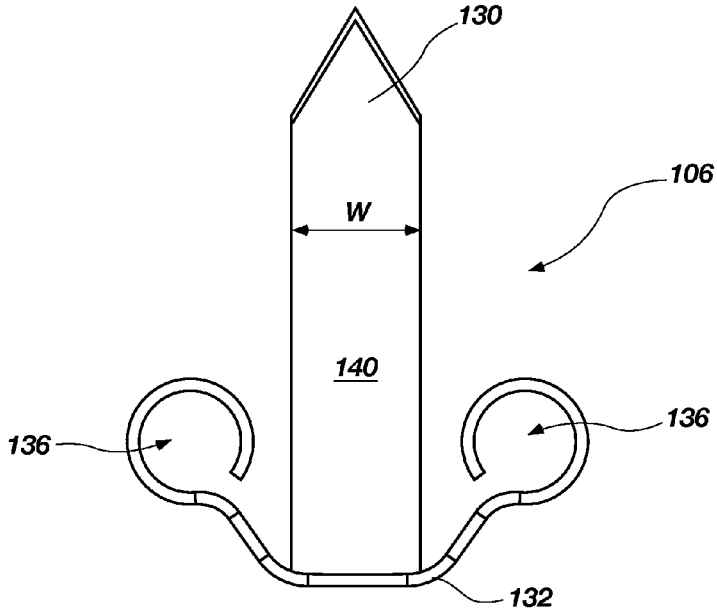
FIG. 8 is a top view of the hinge member of FIG. 7.
Figure 9:
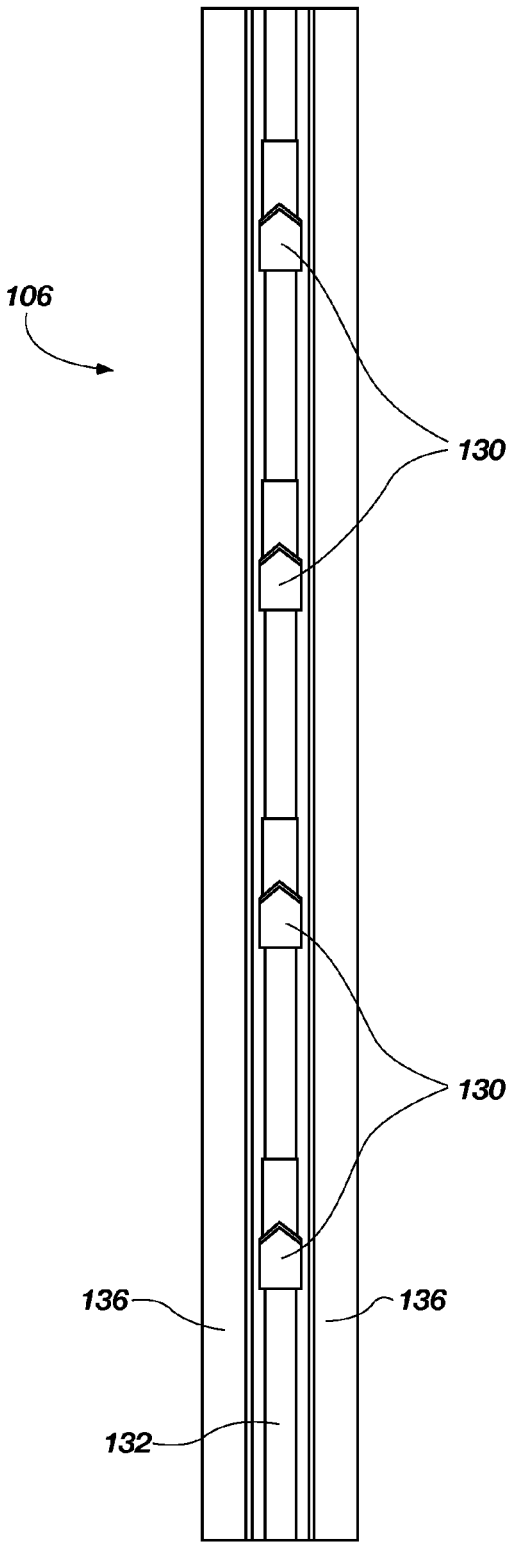
FIG. 9 is a front view of the hinge member of FIG. 7.

Referring to FIG. 8, a top view of the hinge member 106 of FIG. 7 is shown. The pointed members 130 protruding from the hinge member 106 may comprise a width w extending in a direction at least substantially transverse to vertical. When sheets of insulation 128 (see FIG. 4) are installed, the weight of the sheets of insulation 128 may be carried by an upper surface 140 of the pointed members 130, the upper surface 140 having a width w. For example, the pointed members 130 may comprise a width w of at least about one-half centimeter (0.5 cm). Referring to FIG. 9, a front view of the hinge member 106 of FIG. 7 is shown. The pointed members 130 may be positioned at a constant interval along the entire height of the hinge member 106. For example, a pointed member 130 may be placed at a constant interval at least once every eighteen inches (18 in) along the height of the hinge member 106. In other embodiments, pointed members 130 may be located at a constant interval at least once every six inches (6 in) along the height of the hinge member 106. In still other embodiments, the pointed members 130 may be placed at inconstant intervals along the height of the hinge member 106. For example, clusters of four pointed members 130 three inches (3 in) apart may be placed near the top, bottom, and middle portions of the hinge members 106.

Figure 10:
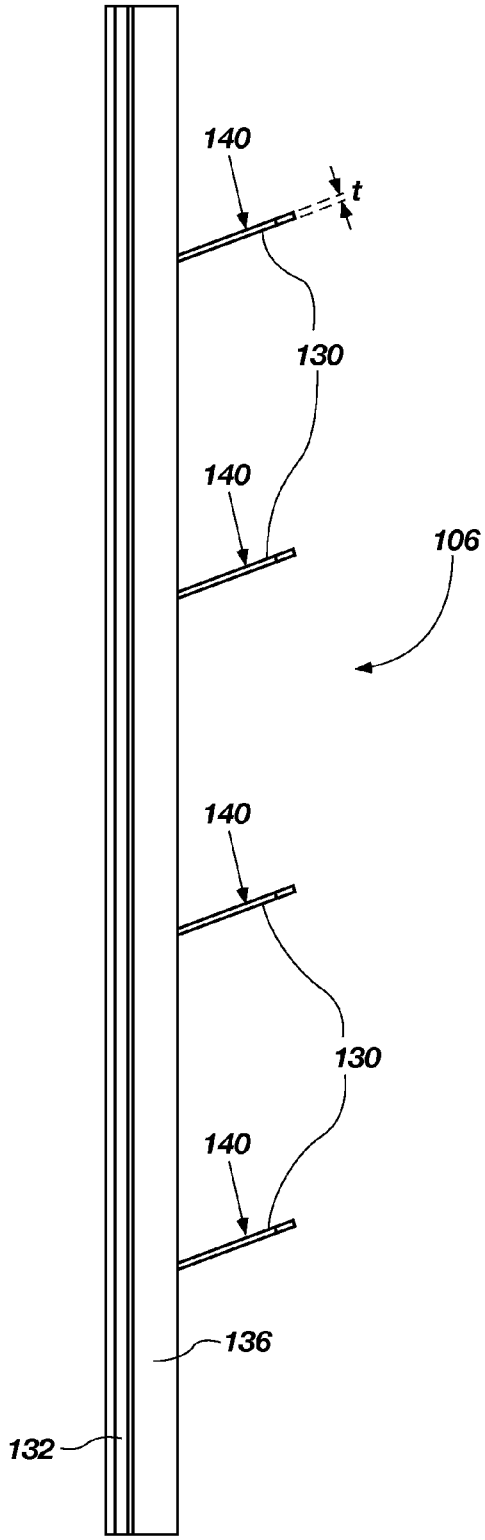
FIG. 10 is a side view of the hinge member of FIG. 7.

Referring to FIG. 10, a side view of the hinge member 106 of FIG. 7 is shown. The pointed members 130 may comprise a thickness t. The thickness t of the pointed members 130 may be substantially less than the width w (see FIG. 8) of the upper surface 140 of the pointed members 130. For example, the thickness t of the pointed members 130 may be at least about two times smaller, at least about five times smaller, at least about seven times smaller, or even at least about ten times smaller than the width w of the pointed members 130. In embodiments where the pointed members 130 are formed from a sheet of material, the width w (see FIG. 8) of the upper surface 140 of the pointed members 130 may be greater, therefore, than the thickness of the material from which the pointed members 130 are formed. Accordingly, the orientation of the pointed members 130 may prevent cutting, tearing, and sagging of the sheets of insulation 128 (see FIGS. 3 and 4) in the vertical direction and retain the sheets of insulation 128 (see FIGS. 3 and 4) at a desired vertical position within a space between two laterally spaced and substantially parallel partitions 118.

Figure 11:
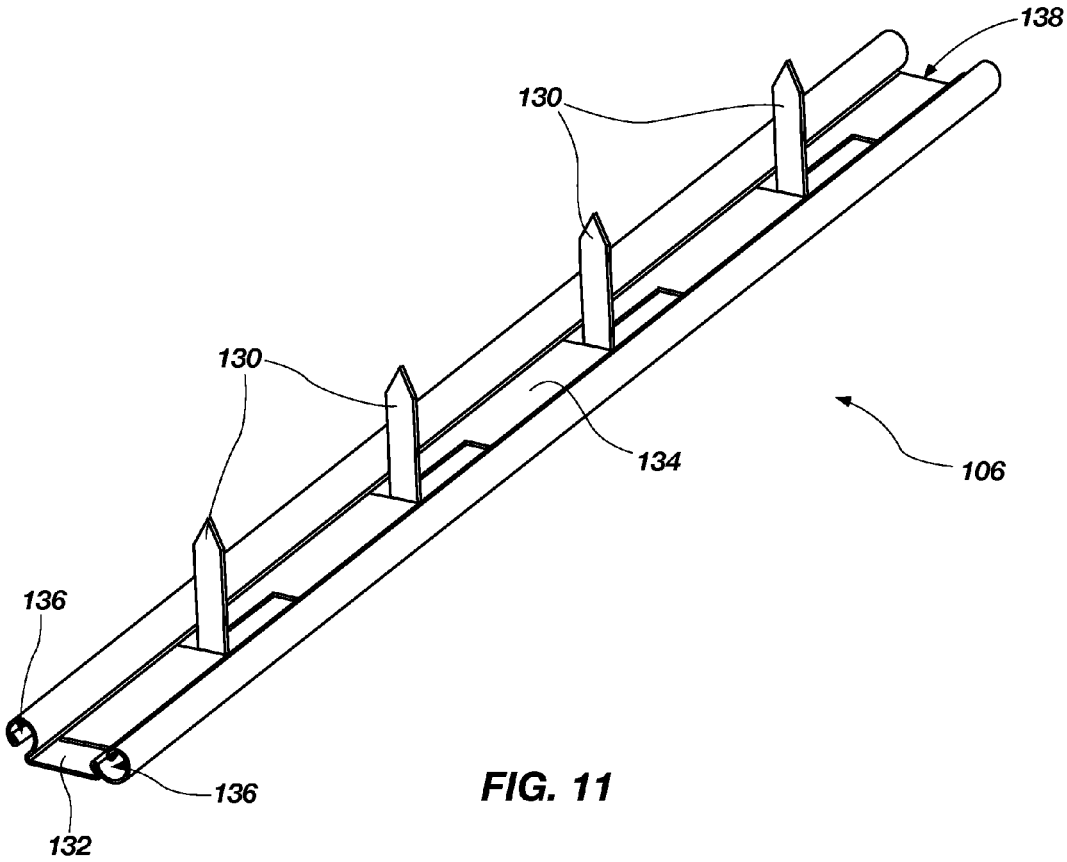
FIG. 11 is a simplified illustration of a hinge member for a partition system according to an embodiment of the present disclosure.

Referring to FIG. 11, a simplified illustration of another embodiment of a hinge member 106 for a partition system is shown. The hinge member 106 may comprise an elongate member formed from a first sheet 132 of material, such as, for example, sheet metal, that has been bent or otherwise formed to include annular structures 136 at the sides thereof to which panels 104 of a partition 118 (see FIG. 6) may be rotatably attached. The annular structures 136 may be configured to retain connection portions of the panels 104 therein as the partition 118 is extended or refracted and panels 104 rotate relative to the hinge member 106. The annular structures 136 may not comprise completely closed loops, an opening in the annular structure 136 being located between a terminal end of the annular structure 136 and the sheet 132 of material. The annular members 136 may curve inwardly toward the center of the hinge member 106 or may curve outwardly away from the center of the hinge member 106.

The hinge member 106 may comprise a second sheet 134 of material including a plurality of pointed members 130 formed in the second sheet 134 and protruding therefrom. The pointed members 130 may comprise portions of the second sheet 134 of material that have been cut, punched out, or otherwise separated from the second sheet 134 on all but one side and then bent or folded to protrude from the second sheet 134. In other embodiments, the pointed members 130 may comprise separate members that are formed as pointed members 130 and subsequently attached to the hinge member 106. The portion of each pointed member 130 that is not cut, punched out, or otherwise separated from the second sheet 134 may extend in a direction transverse to vertical. The pointed members 130 may be configured to at least partially penetrate into sheets of insulation 128.

Figure 12:
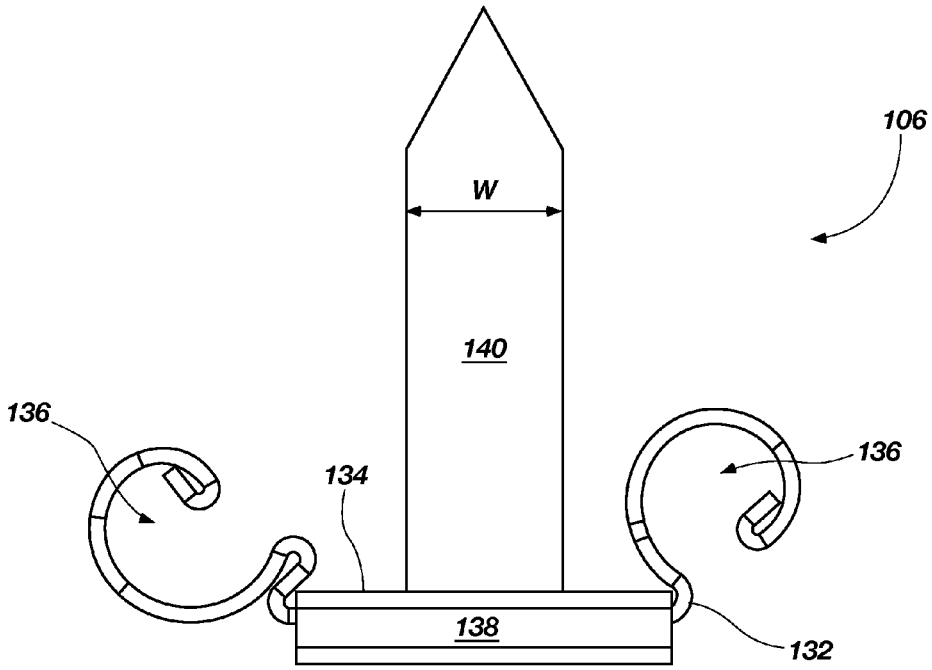
FIG. 12 is a top view of the hinge member of FIG. 11.

With reference to FIG. 12, a top view of the hinge member of FIG. 11, the second sheet 134 of material may be assembled with the first sheet 132 of material to form the hinge member 106. The annular structures 136 may be formed such that portions of the annular members 136 proximate a central portion of the hinge member 106 may extend inwardly toward the central portion. The elongate second sheet 134 of material may be inserted between the annular structures 136, the portions of the annular structures 136 that extend inwardly toward the central portion of the hinge member 106 serving to restrain movement of the second sheet 134 in a lateral direction (i.e., in a direction at least substantially transverse to vertical). In some embodiments, the portions of the annular structures 136 that extend inwardly toward the central portion of the hinge member 106 may form an interference fit with the second sheet 134.

The pointed members 130 protruding from the hinge member 106 may comprise a width w extending in a direction at least substantially transverse to vertical. When sheets of insulation 128 (see FIG. 4) are installed, the weight of the sheets of insulation 128 may be carried by the upper surface 140 of the pointed members 130, the upper surface 140 having a width w. For example, the pointed members 130 may comprise a width w of at least about one-half of a centimeter (0.5 cm).

The top portion of the second sheet 134 of material may include a bent portion 138. The bent portion 138 may be bent to form a semi-circular hook. In other embodiments, the bent portion 138 may comprise a single ninety degree (90°) bend or two ninety degree (90°) bends in succession to form a half-rectangular hook. The bent portion 138 may restrain movement of the second sheet 134 of material in a longitudinal direction (i.e., in a direction at least substantially parallel to vertical). When assembling the hinge member 106, the second sheet 134 of material comprising the pointed members 130 may be slid from the top of the first sheet 132 of material down in between the annular structures 136 until the bent portion 138 rests on and engages with the top of the first sheet 132.

Figure 13:
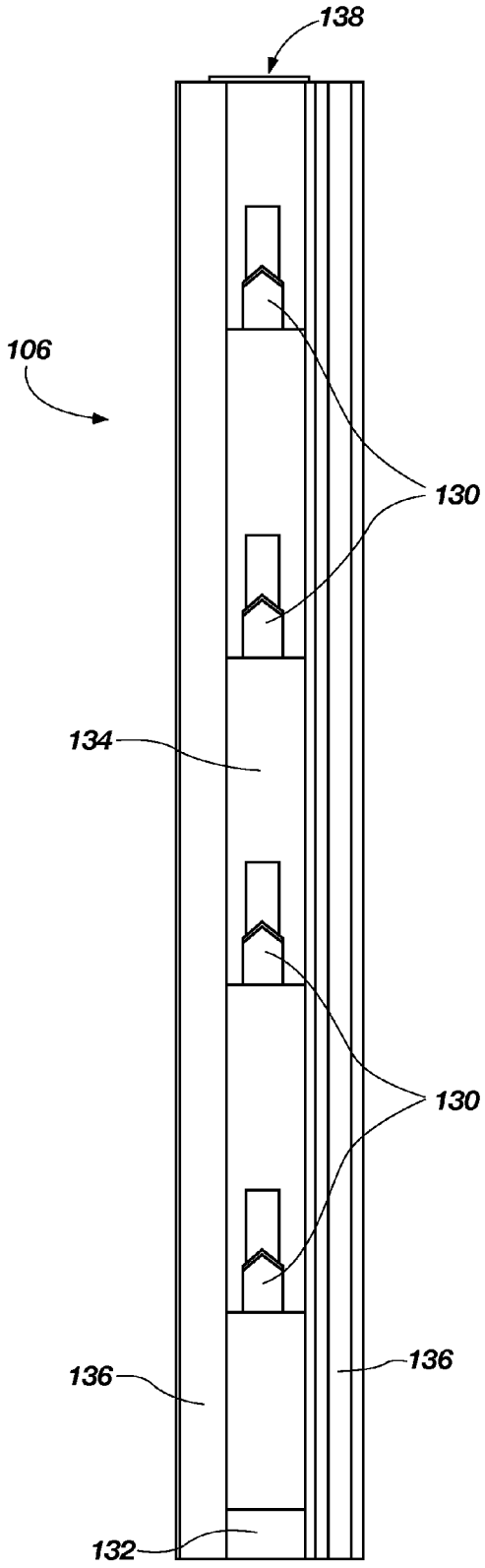
FIG. 13 is a front view of the hinge member of FIG. 11.

With reference to FIG. 13, a front view of the hinge member of FIG. 11 is shown. The pointed members 130 may be positioned at a constant interval along the entire height of the hinge member 106. For example, a pointed member 130 may be placed at a constant interval at least once every eighteen inches (18 in) along the height of the hinge member 106. In other embodiments, pointed members 130 may be located at a constant interval at least once every six inches (6 in) along the height of the hinge member 106. In still other embodiments, the pointed members 130 may be placed at inconstant intervals along the height of the hinge member 106. For example, clusters of four pointed members 130 three inches (3 in) apart may be placed near the top, bottom, and middle portions of the hinge members 106.

Figure 14:
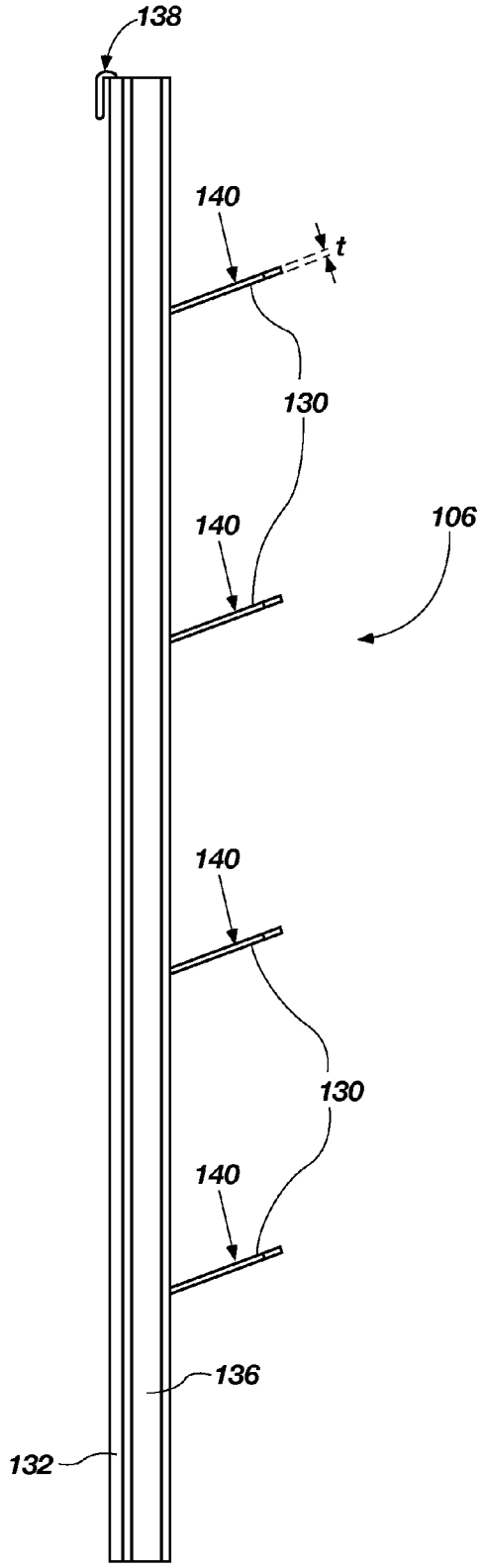
FIG. 14 is a side view of the hinge member of FIG. 11.

With reference to FIG. 14, a side view of the hinge member of FIG. 11 is shown. The pointed members 130 may comprise a thickness t. The width w (see FIG. 12) of the upper surface 140 of the pointed members 130 may be substantially greater than the thickness t of the pointed members 130. For example, the width w of the pointed members 130 may be at least about ten times greater than the thickness t of the pointed members 130. In embodiments where the pointed members 130 are formed from a sheet of material, width w (see FIG. 12) of the upper surface 140 of the pointed members 130 may be greater, therefore, than the thickness of the material from which the pointed members 130 are formed. Accordingly, the orientation of the pointed members 130 may prevent cutting, tearing, and sagging of the sheets of insulation 128 (see FIGS. 3 and 4) in the vertical direction and retain the sheets of insulation 128 (see FIGS. 3 and 4) at a desired vertical position within a space between two laterally spaced and substantially parallel partitions 118.

While the present disclosure has been described herein with respect to certain embodiments, those of ordinary skill in the art will recognize and appreciate that it is not so limited. Rather, many additions, deletions, and modifications to the embodiments described herein may be made without departing from the scope of the disclosure as hereinafter claimed, including legal equivalents. In addition, features from one embodiment may be combined with features of another embodiment while still being encompassed within the scope of the disclosure as contemplated by the inventors.

What is claimed is:

1. A movable partition, comprising:

a plurality of interconnected panels;

at least one sheet of insulation adjacent the plurality of interconnected panels; and at least one hinge member connecting adjacent panels of the plurality of interconnected panels, the at least one hinge member comprising at least one pointed member extending therefrom and at least partially inserted into the at least one sheet of insulation, the at least one sheet of insulation being supported by a surface of the at least one pointed member having a width that is greater than a thickness of the at least one pointed member, wherein the at least one sheet of insulation is attached to the hinge members at laterally innermost, laterally outermost, or laterally innermost and laterally outermost positions on the movable partition when the movable partition is in a retracted position.

2. The movable partition of claim 1, wherein the width of the surface of the at least one pointed member is at least ten times greater than the thickness of the at least one pointed member.

3. The movable partition of claim 1, wherein the width of the surface of the at least one pointed member is at least one-half of one centimeter (0.5 cm).

4. The movable partition of claim 1, wherein the plurality of interconnected panels is configured to extend from a refracted state to an extended state.

5. The movable partition of claim 1, wherein the at least one sheet of insulation comprises a material selected from the group consisting of fiberglass, alumina, silica, and magnesia.

6. The movable partition of claim 1, wherein the at least one sheet of insulation is between about one-half of an inch (0.5 in) and one and one-half inches (1.5 in) thick.

7. The movable partition of claim 1, further comprising:

another plurality of interconnected panels laterally spaced from and generally parallel to the plurality of interconnected panels to define a space therebetween.

8. The movable partition of claim 7, wherein the at least one sheet of insulation is disposed in the space between the plurality of interconnected panels and the another plurality of interconnected panels.

9. The movable partition of claim 1, wherein at least a portion of the at least one pointed member extends entirely through the at least one sheet of insulation and protrudes beyond a major surface of the at least one sheet of insulation.

10. The movable partition of claim 9, wherein a portion of the at least one pointed member that protrudes beyond the major surface of the at least one sheet of insulation is bent and extends in a vertically oriented direction.

11. The movable partition of claim 1, wherein the at least one pointed member comprises a plurality of pointed members located at intervals along a length of the at least one hinge member.

12. The movable partition of claim 11, wherein the pointed members of the plurality of pointed members are separated from adjacent pointed members of the plurality of pointed members by a distance of about eighteen inches (18 in) or less.

13. The movable partition of claim 1, wherein the at least one hinge member comprises an elongate member having a first annular structure at a first side thereof and a second annular structure at a second side thereof.

14. The movable partition of claim 13, wherein the at least one pointed member extends from a portion of the at least one hinge member between the first annular structure and the second annular structure.

15. The movable partition of claim 14, wherein the at least one pointed member extends from a sheet of material disposed between and laterally restrained by the first annular structure and the second annular structure.

16. The movable partition of claim 15, wherein the sheet of material comprises a bent portion disposed over a top end surface of the elongate member, the bent portion of the sheet of material restraining movement of the sheet of material in at least one vertically oriented direction.

17. A method of installing a partition system, comprising:

hanging at least one partition comprising a plurality of panels interconnected using a plurality of hinge members from a track;

pushing at least one sheet of insulation against at least one pointed member extending from at least one hinge member of the plurality of hinge members and causing at least a portion of the at least one pointed member to extend at least partially through the at least one sheet of insulation; and suspending the at least one sheet of insulation on a surface of the at least one pointed member having a width that is greater than a thickness of the at least one pointed member, wherein the at least one sheet of insulation is attached to the hinge members at laterally innermost, laterally outermost, or laterally innermost and laterally outermost positions on the movable partition when the movable partition is in a retracted position.

18. The method of claim 17, wherein causing the at least a portion of the at least one pointed member to extend at least partially through the at least one sheet of insulation comprises causing the at least a portion of the at least one pointed member to protrude beyond a major surface of the at least one sheet of insulation on a side of the at least one sheet of insulation opposite the at least one hinge member.

19. The method of claim 18, further comprising bending a portion of the at least one pointed member such that a portion of the at least one pointed member extends in a vertically oriented direction.

20. The method of claim 17, wherein suspending the at least one sheet of insulation on the surface of the at least one pointed member having a width that is greater than a thickness of the at least one pointed member comprises suspending the at least one sheet of insulation on a surface of the at least one pointed member having a width that is at least ten times greater than the thickness of the at least one pointed member.

21. The method of claim 20, further comprising forming the width of the surface of the at least one pointed member to be at least one-half of one centimeter (0.5 cm).

* * * * *

UNITED STATES PATENT AND TRADEMARK OFFICE

CERTIFICATE OF CORRECTION

PATENT NO. : 8,863,814 B2
APPLICATION NO. : 13/023596
DATED : October 21, 2014
INVENTOR(S) : R. Scott Smart and Craig G. Bell It is certified that error appears in the above-identified patent and that said Letters Patent is hereby corrected as shown below:

In the claims:

CLAIM 4, COLUMN 9, LINE 10, change "refracted" to --retracted--

Signed and Sealed this
Twenty-ninth Day of September, 2015

Michelle K. Lee

Michelle K. Lee
*Director of the United States Patent and Trademark Office*